US007018070B2

(12) United States Patent
McCoy

(10) Patent No.: US 7,018,070 B2
(45) Date of Patent: Mar. 28, 2006

(54) FLUORESCENT LAMPHOLDER WITH DISCONNECTABLE PLUG ON BACK

(75) Inventor: Phillip A. McCoy, Albion, IN (US)

(73) Assignee: Dekko Technologies, Inc., North Webster, IN (US)

( * ) Notice: Subject to any disclaimer, the term of this patent is extended or adjusted under 35 U.S.C. 154(b) by 281 days.

(21) Appl. No.: 10/661,708

(22) Filed: Sep. 12, 2003

(65) Prior Publication Data

US 2005/0057926 A1 Mar. 17, 2005

(51) Int. Cl.
*F21V 17/00* (2006.01)

(52) U.S. Cl. ..... 362/260; 362/306

(58) Field of Classification Search ..... 362/260, 362/296, 306, 341, 549
See application file for complete search history.

(56) References Cited

U.S. PATENT DOCUMENTS 4,626,747 A 12/1986 Nilssen ..... 315/209
4,631,648 A 12/1986 Nilssen ..... 362/150
4,651,059 A 3/1987 Nilssen ..... 315/182
4,667,133 A 5/1987 Nilssen ..... 315/312
5,003,227 A 3/1991 Nilssen ..... 315/161
5,047,696 A 9/1991 Nilssen ..... 315/312
5,189,339 A * 2/1993 Peshak ..... 315/58
5,262,700 A 11/1993 Nilssen ..... 315/223
5,479,326 A 12/1995 Nilssen ..... 362/148
5,584,575 A * 12/1996 Fickel ..... 362/364
5,720,548 A * 2/1998 Geary ..... 362/260
5,800,050 A * 9/1998 Leadford ..... 362/296
5,998,936 A 12/1999 Nilssen ..... 315/209
6,168,299 B1 * 1/2001 Yan ..... 362/365
6,305,829 B1 * 10/2001 Thomas et al. ..... 362/519

* cited by examiner

*Primary Examiner*—Laura K. Tso
(74) *Attorney, Agent, or Firm*—Taylor & Aust, P.C.

(57) ABSTRACT

A flourescent lamp assembly including a reflector having a cutout, a flourescent lamp and a lampholder. The lampholder includes a base end positioned within the cutout, a socket receiving the flourescent lamp and a first plug-in connector of a first gender for receiving electrical power. The first plug-in connector is positioned at the base end and generally opposite from the socket. The first plug-in connector includes a line conductor and a neutral conductor.

21 Claims, 2 Drawing Sheets

FLUORESCENT LAMPHOLDER WITH DISCONNECTABLE PLUG ON BACK

BACKGROUND OF THE INVENTION

1. Field of the Invention

The present invention relates to lampholders, and, more particularly, to a fluorescent lampholder.

2. Description of the Related Art

Compact fluorescent lamps (CFL's) are physically smaller versions of standard fluorescent lamps. They typically consume between 5 to 40 watts, and have a brightness and color rendition that is comparable to incandescent lights of greater wattage. Unlike standard fluorescent lamps, some compact fluorescent lamps can directly replace standard incandescent bulbs.

CFL's work similar to standard fluorescent lamps. A gas-filled tube and a magnetic or electronic ballast make up the two major parts of CFL's. The gas in the tube glows with ultraviolet light when electricity from the ballast flows through it, which in turn, excites a white phosphor coating on the inside of the tube, thereby emitting visible light throughout the surface of the tube. By bending the glass tube back on itself lamp manufacturers have succeeded in making CFL's relatively compact. Incandescent lamps work differently. Much of the electricity used by the incandescent lamp heats a tungsten filament until it glows white hot. As a result, incandescent lamps generate far more heat than a fluorescent light for a given wattage.

Compact fluorescent lamps are much shorter and shallower than conventional tubular fluorescent lamps, whether operated with conventional controls or electronic controls. CFL's open up new possibilities for economical energy-saving light in smaller and more elegant luminaires. Despite having virtually the same high luminous flux and the same power consumption as tubular fluorescent lamps, CFL's are less than half as long and more compact than cylindrical and ring-type lamps.

Typical compact fluorescent lamps are either pin-based (they plug into a lampholder) or they are medium screw-based (they screw into a socket the same as common incandescent bulbs). Pin-based compact fluorescent bulbs can include an abbreviated base designation according to the American National Standards Institute (ANSI). An ANSI G24 abbreviated base designation can be used to identify, for example, lamps that are 26 watt, quad tube and 2 or 4 pin base. Another example of a lamp with a G24 base is a 32 watt triple tube with a 4 pin base, although these examples are not exclusive.

G24 lamps plug into a lampholder which is typically provided electrical input from a ballast or other source of electrical power. A typical lampholder provides mechanical support for the lamp, electrical connection for the lamp via pin receptacles, terminal ports electrically connected to the pin receptacles and accepting wire connection from the ballast, and four screw holes for lampholder mounting. A 4 pin lampholder can include rejection features which prevents the incorrect insertion of a 2 pin lamp.

The terminal ports accept the stripped end of a wire. Such electrical connection can be time consuming, tedious and can require a skilled technician, such as an electrician, to complete. Further, screw holes for lampholder mounting, and the corresponding fasteners, can be time consuming when assembling or disassembling a G24 lampholder.

What is needed in the art is a lampholder which provides reliable and easy electrical connection to electrical input and mechanical connection.

SUMMARY OF THE INVENTION

The present invention provides a fluorescent lampholder that can easily be connected to a source of electrical power.

The invention comprises, in one form thereof, a flourescent lamp assembly, including a reflector having a cutout, a flourescent lamp and a lampholder. The lampholder includes a base end positioned within the cutout, a socket receiving the flourescent lamp and a first plug-in connector of a first gender for receiving electrical power. The first plug-in connector is positioned at the base end and generally opposite from the socket. The first plug-in connector includes a line conductor and a neutral conductor.

An advantage of the present invention is it provides reliable and easy electrical connection to electrical input.

Another advantage of the present invention is it provides reliable and easy mechanical connection.

Yet another advantage of the present invention is it facilitates efficient maintenance and field service of a fluorescent lamp assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
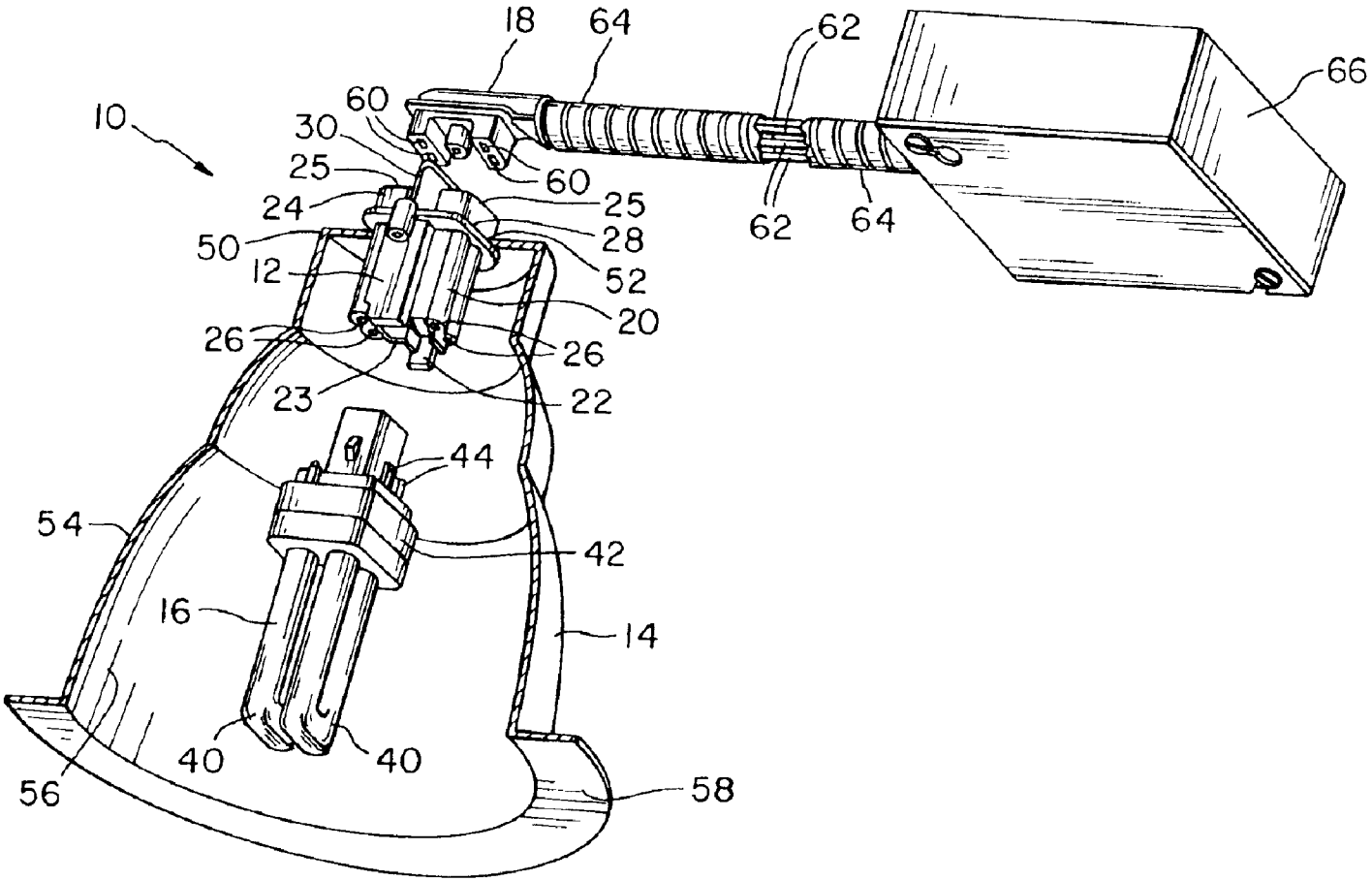
FIG. 1 is a perspective, partially sectional view of an embodiment of a fluorescent lamp assembly according to the present invention.

Referring now to the drawings, and more particularly to FIG. 1, there is shown fluorescent lamp assembly 10 which generally includes lampholder 12, reflector 14 and fluorescent lamp 16. Second plug-in connector 18 provides electrical connection to lampholder 12.

Figure 2:
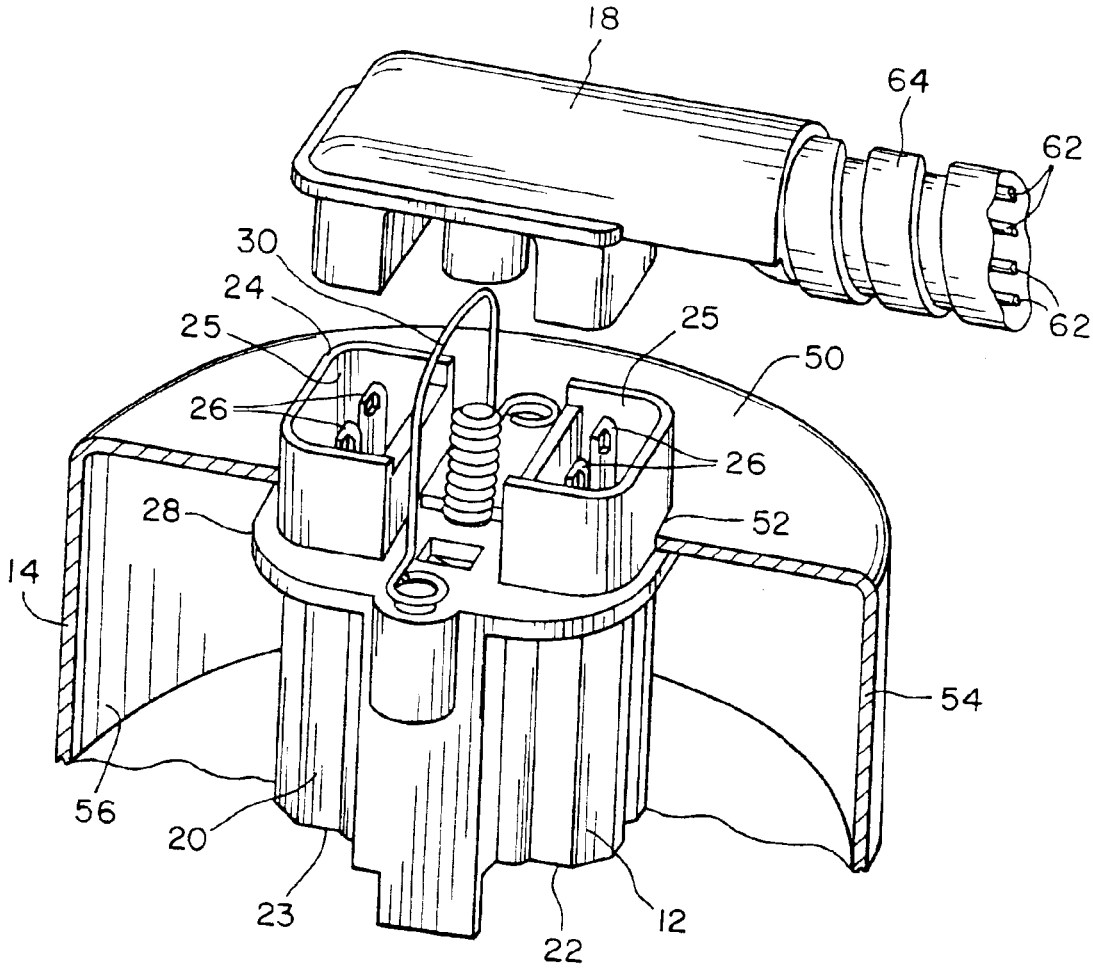
FIG. 2 is an enlarged perspective, partially sectional view of the lampholder of FIG. 1.

Lampholder 12 includes housing 20 having lamp end 22 and input or base end 24. Base end 24 includes first plug-in connector 25 which can either be a male or female gender. Lamp end 22 is configured for releasable connection to fluorescent lamp 16 and includes socket 23. Base end 24 is configured for releasable connection to second plug-in connector 18. Conductors 26 include at least a line and a neutral conductor and electrically interconnect fluorescent lamp 16 and second plug-in connector 18 when both are properly connected to lampholder 12. Conductors 26 can also include a ground conductor, at least one control conductor (for dimming control as an example) and the like. Second plug-in connector 18 can be either a male or female gender. Reflector stop 28 at base end 24 registers lampholder 12 relative to reflector 14. Attachment element 30 (FIG. 2) holds second plug-in connector 18 to lampholder 12. Attachment element 30 is shown as a spring wire, however, attachment element 30 can be fasteners such as screws or nuts and bolts, ties, electrical tape and the like.

Fluorescent lamp 16 includes illumination tubes 40 and base 42. Base 42 includes pins 44 that connect to corresponding conductors 26 in lampholder 12. When connected to an appropriate source of electrical energy base pins 44 provide electrical energy to fluorescent lamp 16 thereby energizing and illuminating tubes 40. Base 42 is shown as a 4 pin ANSI G24 base (there are 2 pins on the side opposite the pins shown in FIG. 1) however, other base configurations are possible, such as a 2 pin configuration or other base types.

Reflector 14 includes lampholder end 50 with cutout 52 allowing projection of base end 24 of lampholder 12 through reflector 14 until interference with reflector stop 28. Reflector body 54 has inner surface 56 that is typically reflective or with a reflective coating. The shape of reflector body 54, the reflective inner surface 56 and the type of lamp 16 and position of lamp 16 relative to reflector body 54 determine the light distribution of fluorescent lamp assembly 10. Mounting flange 58 can facilitate mounting of fluorescent lamp assembly 10 to a ceiling (not shown) or can be for ornamental purposes.

Power cord 64 includes second plug-in connector 18. Second plug-in connector 18 includes conduit terminals 60 which are connected to a source of electrical power via power conductors 62. Power conductors 62 reside in power cord 64 and connect into box 66. Power cord 64 can alternatively be a cable, a conduit, a distribution harness and the like. Box 66 can be a ballast for fluorescent lamp 16, and possibly other lamps (not shown), and/or can be a junction box. Box 66 can have its own source of electrical power, such as solar cells, fuel cells, batteries and the like (not shown), or can be connected to the electrical mains (also not shown). Second plug-in connector 18 is shown as a plug but can also be a receptacle with a corresponding change in base end 24 of lampholder 12.

In use, reflector 24 is mounted in a ceiling (not shown) or the like. Lampholder 12 is positioned adjacent reflector 24 using reflector stop 28 as a reference. Second plug-in connector 18 is plugged into lampholder 12 at base end 24. Fluorescent lamp 16 is plugged into lampholder 12 at lamp end 22. Attachment element 30 can be use to hold second plug-in connector 18 to lampholder 12. When power conductors 62 are energized with an appropriate source of electrical energy, thereby energizing base pins 44 through second plug-in connector 18 and lampholder 12, fluorescent lamp 16 turns on and illuminates an area with light.

Lampholder 12 is easily disconnected from fluorescent lamp assembly 10 by loosening attachment element 30 and unplugging both second plug-in connector 18 and fluorescent lamp 16, thereby facilitating efficient service of fluorescent lamp assembly 10.

Fluorescent lamp assembly 10 can be used with conventional controls or with electronic controls and dimmer systems.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A flourescent lamp assembly, comprising:

a reflector having a cutout;

a flourescent lamp; and a lampholder including a base end positioned within said cutout, a socket receiving said flourescent lamp, and a first plug-in connector of a first gender for receiving electrical power, said first plug-in connector positioned at said base end and generally opposite from said socket, said first plug-in connector including a line conductor and a neutral conductor.

2. The fluorescent lamp assembly of claim 1, further including a power cord with a second plug-in connector of a second gender mating with said first plug-in connector.

3. The fluorescent lamp assembly of claim 2, wherein said first plug-in connector is a female connector and said second plug-in connector is a female connector.

4. The fluorescent lamp assembly of claim 2, further including an attachment element both connectable to said base end and configured for holding said second plug-in connector to said base end.

5. The fluorescent lamp assembly of claim 4, wherein said attachment element is at least one of a spring wire, screw, nut and bolt pair, tie and electrical tape.

6. The fluorescent lamp assembly of claim 2, wherein said power cord is one of a conduit and a cable.

7. The fluorescent lamp assembly of claim 1, wherein said base end includes a reflector stop.

8. The fluorescent lamp assembly of claim 1, wherein said fluorescent lamp has an ANSI G24 base.

9. A lampholder for a fluorescent lamp, comprising:

a base end;

a socket for receiving the flourescent lamp; and a first plug-in connector of a first gender for receiving electrical power, said first plug-in connector positioned at said base end and generally opposite from said socket, said first plug-in connector including a line conductor and a neutral conductor.

10. The lampholder of claim 9, further including a power cord with a second plug-in connector of a second gender mating with said first plug-in connector.

11. The lampholder of claim 10, wherein said first plug-in connector is a female connector and said second plug-in connector is a female connector.

12. The lampholder of claim 11, further including an attachment element both connectable to said base end and configured for holding said second plug-in connector to said base end.

13. The lampholder of claim 12, wherein said attachment element is at least one of a spring wire, screw, nut and bolt pair, tie and electrical tape.

14. The lampholder of claim 10, wherein said power cord is one of a conduit and a cable.

15. The lampholder of claim 9, wherein said base end includes a reflector stop.

16. The lampholder of claim 9, wherein said fluorescent lamp has an ANSI G24 base.

17. A method of electrically connecting a fluorescent lamp assembly, including the steps of:

providing a lampholder including a base end, a socket, and a first plug-in connector of a first gender, said first plug-in connector positioned at said base end and generally opposite from said socket, said first plug-in connector including a line conductor and a neutral conductor;

positioning said base end in a cutout of a reflector;

plugging a power cord into said first plug-in connector, said power cord including a second plug-in connector of a second gender mating with said first plug-in connector; and receiving said fluorescent lamp in said socket.

18. The lampholder of claim 17, wherein said first plug-in connector is a female connector and said second plug-in connector is a female connector.

19. The method of claim 17, further including the step of holding said second plug-in connector to said lampholder with an attachment element.

20. The method of claim 17, wherein said power cord is one of a conduit and a cable.

21. The method of claim 17, wherein said fluorescent lamp has an ANSI G24 base.

* * * * *